United States Patent [19]

Larson

[11] 4,139,454

[45] Feb. 13, 1979

[54] RECLAIMING SYSTEM FOR SCRAP METALS

[76] Inventor: Robert W. Larson, 605 S. Eldorado Rd., Mesa, Ariz. 85202

[21] Appl. No.: 840,109

[22] Filed: Oct. 6, 1977

[51] Int. Cl.[2] ..... B03B 9/06

[52] U.S. Cl. ..... 209/12; 209/139 R; 209/157; 209/452

[58] Field of Search ..... 209/12, 13, 17–19, 209/36–40, 138, 139 R, 445, 451, 452, 155, 157, 473, 482

[56] References Cited

U.S. PATENT DOCUMENTS

| | | | |
|---|---|---|---|
| 721,103 | 2/1903 | Smith | 209/157 X |
| 2,246,532 | 6/1941 | Prins | 209/18 |
| 2,257,552 | 9/1941 | Hammack | 209/37 X |
| 3,790,091 | 2/1974 | Law et al. | 241/24 |
| 3,848,813 | 9/1974 | Stanczyk et al. | 241/24 X |
| 3,971,474 | 7/1976 | Clement | 209/39 X |
| 4,043,513 | 8/1977 | Hoberg et al. | 241/DIG. 38 X |

FOREIGN PATENT DOCUMENTS

| | | | |
|---|---|---|---|
| 2420836 | 11/1975 | Fed. Rep. of Germany | 209/12 |

OTHER PUBLICATIONS

Boettcher, "Air Classification for Reclamation Processing of Solid Waste", ASME Paper 69-WA/PID-9, 1969.

*Primary Examiner*—Ralph J. Hill
*Attorney, Agent, or Firm*—Warren F. B. Lindsley

[57] ABSTRACT

A mechanized reclaiming system for separating ferrous and non-ferrous metals from other materials derived from crushed and shredded automobiles employing a pair of conveyors mounted in a vertical array with the top one separating under vibratory action the small particles of material from the larger particles with the small particles going to a processing tower with this material being processed again into lighter and heavier materials. The lighter material is separated further by centrifugal action while the heavier material is separated into magnetic and non-magnetic material by magnetic means with the non-magnetic material being further separated into light and heavier material through water treatment in a rotating drum.

4 Claims, 3 Drawing Figures

RECLAIMING SYSTEM FOR SCRAP METALS

BACKGROUND OF THE INVENTION

The reclamation of metals from discarded automobiles and other end-of-life equipment has become a highly mechanized operation requiring a maximum degree of optimization in terms of the conservation of materials and energy. The importance of recycling such scrap materials as iron, copper, aluminum and other metals becomes increasingly apparent as the depletion of ore reserves drives prices higher and higher. At the same time, the high cost of fuels and the high level of energy utilization involved in the separation and refinement of metals makes it doubly important that the salvage operations be rendered as effective and efficient as possible.

In a typical salvage operation, complete automobile bodies including frames, engines, seats, upholstery and the rest are first crushed and compacted for shipment to a salvage operation. The compacted automobiles are then fed into a shredder, a huge and powerful machine with heavy cleated roller size pieces of iron, steel, brass, glass, etc. As these pieces of scrap metal are exhausted from the shredder, a large percentage of the ferrous materials are separated from the mass of the material by means of a large magnetic roller, but the residue contains along with the glass, cloth, rubber, wood, dirt, tar, etc., a significant amount of ferrous and non-ferrous metals which must be salvaged for reuse.

Heretofore the separation of metals from this residue was largely a hand operation in which the useful materials were picked from a moving conveyor belt. Because of the high cost of labor there is a limit to the percentage of the total metal content of the residue which can be recovered in this manner, i.e., bits and pieces of metal below a given size are not worth the cost of the labor required for separation.

While various known chemical, electro-chemical and metallurgical processes are useable for the recovery of the balance of the materials that are not removed by hand separation, the costs of these processes including the high energy costs involved suggest the need for a mechanized alternative to the hand-picking operation.

SUMMARY OF THE INVENTION

In accordance with the invention claimed, an improved metal reclaiming system is provided for separating ferrous and non-ferrous metals from other waste products, the system incorporating air, magnetic and water subsystems.

It is, therefore, one object of this invention to provide an improved reclaiming system for scrap metals.

Another object of this invention is to provide such a reclaiming system in a highly mechanized form which eliminates all but a minimal content of hand labor.

A further object of this invention is to provide such a system in a form which salvages a maximum percentage of the total metal content from the initial charge of waste and salvageable materials.

A still further object of this invention is to provide such a system in a form which delivers the salvaged metals in a clean or washed condition.

A still further object of this invention is to provide such a system with a capability for separating ferrous and non-ferrous products.

A still further object of this invention is to provide such a system in a form which emits a minimum level of pollutants to the atmosphere.

A still further object of this invention is to provide a highly optimized reclaiming system which produces maximum benefits in terms of the conservation of energy and materials.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figures 1, 2:
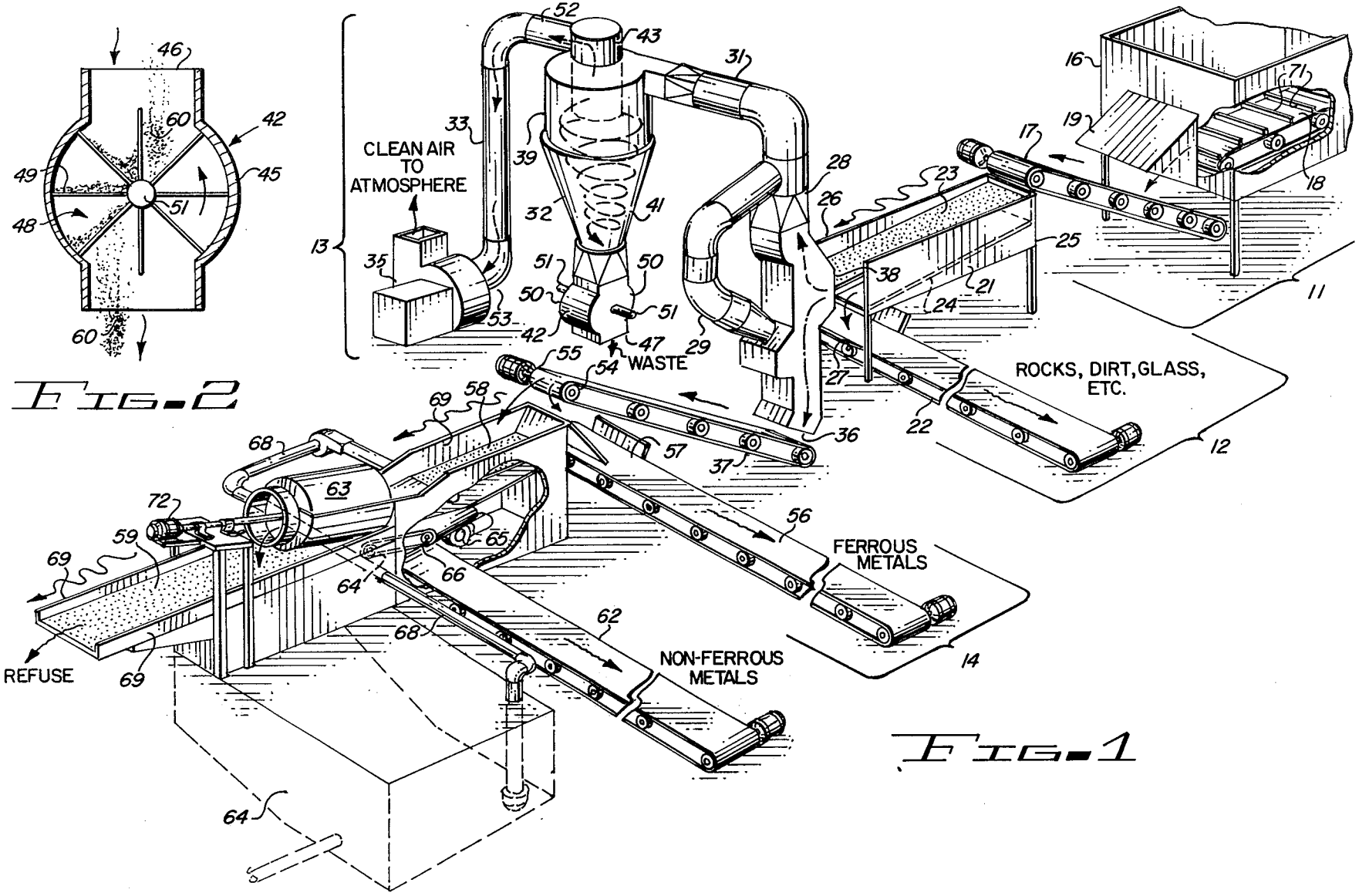
FIG. 1 is a perspective view of the total reclaiming system of the invention.
FIG. 2 is a cross-sectional view of a waste removal duct employed in the air subsystem of the reclaiming system.
Figure 3:
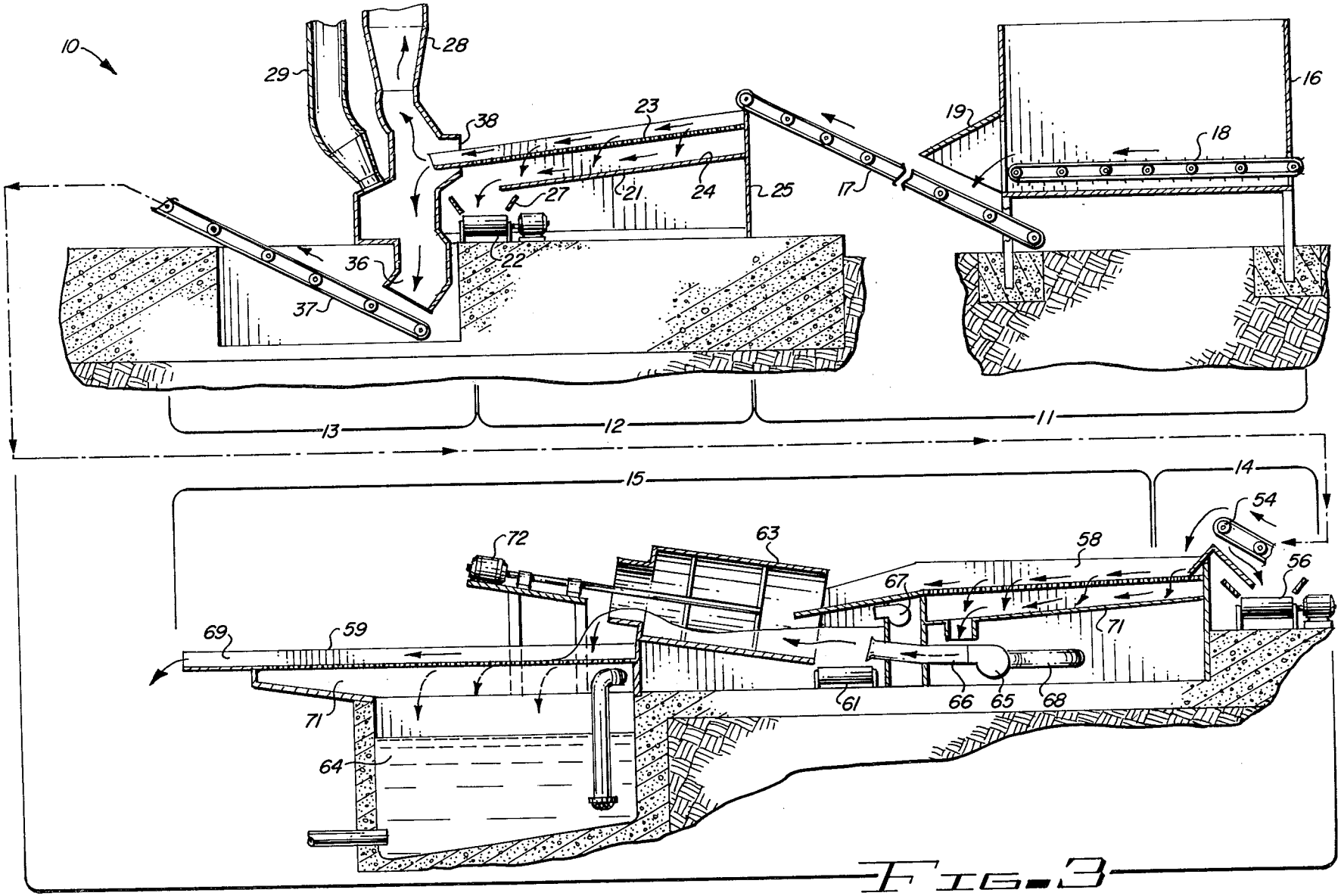
FIG. 3 is a cross-sectional side view of a portion of the reclaiming system incorporating air, magnetic and water subsystems.

Referrring more particularly to the drawing by characters of reference, FIGS. 1 and 3 illustrate the reclaiming system 10 of the invention comprising a number of subsystems including an input stage 11, a sifter stage 12, an air subsystem 13, a magnetic separator 14, and a water subsystem 15.

The input stage 11 includes a hopper or feeder box 16 and an inclined conveyor 17. Feeder box 16 is simply a large rectangular steel box open at the top and fitted with a moving drag conveyor 18 directed toward an outlet opening 19 which opens at the lower or pick-up end of conveyor 17, conveyor 17 comprising an ordinary belt transporting means.

The sifter stage 12 comprises an inclined vibrating shaker conveyor 21 and a refuse conveyor 22. Conveyor 21 is a two-level conveyor which has an inclined upper level 23 and an inclined lower level 24. Both levels 23 and 24 are inclined downward from the intake end 25 thereof to the discharge end 26. The upper level 23 has a plane perforated surface with openings slightly larger than five-eighths of inch in diameter while the lower level 24 comprises a plane surface without openings. Refuse conveyor 22 has an intake hopper 27 located directly below the discharge end of the lower level 24 and in oriented perpendicularly relative to shaker conveyor 21.

The air subsystem 13 comprises a main vertical intake tower 28 having a secondary channel 29, a horizontal passage 31, a centrifuge cleaning tower 32, a clean air exhaust tower 33 and a fun unit 35.

The intake tower 28 is fabricated of heavy gage sheet metal with its lower end being rectangular in cross-section and its upper end terminating in a circular cross-sectional configuration. The rectangular opening 36 of the intake tower 28 is directed toward the lower and intake end of an inclined conveyor 37. Just upward a short distance from the lower end of tower 28 is provided a second opening 38 in the side of tower 28 which faces the exhaust end of upper level 23 of conveyor 21.

Secondary channel 29 is constructed primarily of circular sheet-metal pipe sections somewhat smaller in cross-sectional area than the main channel of tower 28. Its intake end is attached to an opening into the side wall of tower 28 at a point midway between openings 36 and 38 and on the wall opposite opening 38. The outlet end of channel 29 re-enters the side of tower 28 at a point near the upper end of tower 28. The upper end of tower 28 empties into horizontal passage 31 which leads into the upper end of cleaning tower 32.

Cleaning tower 32 has a cylindrical circulator 39 at its upper end, a conical spiral separator 41 located just below circulator 39, and an air-sealed discharge valve 42 at its lower end.

Cylindrical circulator 39 has an air-discharge stack 43 extending downward through the center of its closed top surface. The outlet of passage 31 opens tangentially into the side of circulator 39 near the upper end thereof and into the space lying between the outer surface of stack 43 and the vertical wall of circulator 39. The downward extension of stack 43 forms between its outer surface and the inner cylindrical surface of circulator 39 a doughnut-shaped chamber forming the intake chamber for tower 32.

Separator 41 is funnel-shaped and has its large upper end 43 opening into the lower end of circulator 39 while its smaller lower end 44 opens into the top of valve 42.

Valve 42 has a cylindrical main body 45 oriented horizontally with an intake opening 46 in its upper surface and an exhaust opening 47 in its lower surface. Both ends of body 45 are closed by flat end plates 50, the centers of which carry the bearing supports for a rotating paddlewheel 48 having a number of flat rectangular vanes 49 attached to an axle 51. The outer edges of vanes 49 operate in sufficiently close proximity to the inner surface of the cylindrical body 45 to form an effective air seal relative to the total velocity of air passing through tower 32. At the same time, the rotating paddlewheel 48 can translate solid matter 60 from above to the opening below.

The upper end of the clean-air exhaust tower 33 connects to the side of stack 43 and the lower end 53 connects to the air intake port of fan unit 35.

Magnetic separator 14 comprises the inclined belt conveyor 37 with a magnetic roller 54 located at its upper discharge end 55 thereof. A second belt conveyor 56 is arranged perpendicularly relative to conveyor 37 as seen from above with its pick-up end 57 located directly below the discharge end 55 of conveyor 37.

The water subsystem 15 comprises first and second shaker conveyors 58 and 59, respectively, rotating water drum 63, a water sump 64, water pump 65 having an associated primary water discharge nozzle 66 and an auxiliary high velocity discharge nozzle 67 shown in FIG. 3.

As viewed from above conveyor 58, drum 63 and conveyor 59 are in linear consecutive alignment while conveyors 61 and 62 extend laterally from the discharge end of conveyor 58. Drum 63 is open at both ends and is inclined somewhat from the horizontal, its lower end being positioned to receive the discharge from conveyor 58 and its elevated end being positioned directly above the receiving end of conveyor 59. Conveyor 61 slopes appreciably upward from its receiving end which is located below the lower end of drum 63. Its elevated upper end terminates directly above the receiving end of conveyor 62. Conveyor 62 is substantially horizontal.

The intake of pump 65 is fed by a water pipe 68 which leads to the bottom of sump 64 and the stream of water ejected by pump 65 through nozzle 66 is directed into the lower end of drum 63. Conveyors 58 and 59 have continuous and common side walls 69 which are integral with a collection tank 71 underlying both conveyors 58 and 59 into which the water ejected by nozzle 66 finds its way and from which it drains into sump 64.

In operation, the system 10 functions as follows:

The input charge of material which is loaded into feeder box 16 contains, in addition to the metal which is to be salvaged, all the other waste materials common to automobiles including bits of upholstery, fiberglass, plastic and glass, among other things. The moving drag conveyor 18 with its heavy metal cleats moves this mixture of materials out of the bottom of box 16 and deposits it at a controlled rate on the input end of conveyor 17 which carries it to the intake end of shaker conveyor 21.

As the material is moved along the length of the upper level 23 of conveyor 21 by the vibrating action of conveyor 21, the small particles of rocks, dirt, glass, etc. under 5/8 inch in diameter fall through perforations in the upper level 23 to the lower level 24 which has a continuous or closed surface that is inclined sharply downward so that the small particles of material move downward toward the discharge end from which they fall into the intake hopper 27 of refuse conveyor 22. Conveyor 22 carries the waste material separated by the sifter stage 12 to a collection container or to a transport means positioned at its discharge end.

The material retained by upper level 23 moves gradually to the discharge end 26 from which they are ejected into opening 38 of tower 28 for processing by the air subsystem 13. As the material enters tower 28 through opening 38, the heavier pieces of metal, rock, hard rubber, heavy wood, etc. fall downward through opening 36 onto the pickup end of conveyor 37 while the lighter particles such as upholstery, fiberglass, dust, etc. are caught up in the air stream which transports them through passage 31 to circulator 39. Some of the lighter material initially falling downward from opening 38 is separated by air turbulence from the heavier falling materials and is carried upward by a secondary air draft through channel 29 and then passage 31 again to circulator 39.

By virtue of the tangential entry of passage 31 into the doughnut-shaped interior of circulator 39, the refuse-laden air stream entering circulator 39 spirals around the cylindrical walls of circulator 39 progressing in a spiral path downwardly into the conical or funnel-shaped interior of separator 41. The centrifugal forces act on the circulating air stream to separate the waste materials from the air. Under the influence of this centrifugal separating action, the waste materials find their way to the bottom of separator 41 into discharge valve 42 while the cleaned air stream exhausts upward stack 43, then downward through exhaust tower 33 and through fan 35 from which it is exhausted to the atmosphere.

The heavier materials falling through opening 36 to conveyor 37 are carried to the upper end 55 where on a conveyor it passes over the magnetic roller 54. As the material moves over roller 54 the ferrous materials are attracted magnetically so that they cling to the conveyor belt as it moves around roller 54 and do not fall off until they are carried to the underside of conveyor 37 where the belt leaves the roller. At this point the ferrous materials fall from the belt onto conveyor 56 which deposits them into a collecting container 56 positioned under the discharge end of the conveyor 37.

The non-magnetic materials moving over the discharge end 55 of conveyor 37 fall off end 55 into shaker conveyor 58. Conveyor 58 has a perforated surface so that any remaining small particles of metal less than 3/8 inches in diameter fall through the perforations and are funnelled through a spout directly to the pickup end of conveyor 61. The larger remaining pieces of metal and waste materials are carried to the discharge end of conveyor 58 by its vibrating action. As they leave the end of conveyor 58, they fall into the open end of drum 63 which is constantly rotated by an electric motor 72. Entering the same end of drum 63 is the heavy stream of water from nozzle 66 which produces inside drum 63 a constant charge of turbulent water which carries all contained matter from time to time to the surface of the water. Also impinging upon the surface of the water inside drum 63 is the high-velocity jet of water from nozzle 67 which is directed toward the opening at the elevated end of drum 63.

Under the combined actions of the rotation of drum 63, the turbulence produced by nozzle 66 and the impact of the high-velocity stream from nozzle 67, substantially all materials less dense than metals are carried through the elevated end of drum 63 from which they fall onto conveyor 59 along with water overflowing from drum 63. The water passes through the 60 mesh wire fabric comprising the surface of conveyor 59 and is collected by tank 71 from which it passes to sump 64. At the same time the heavy metal pieces, which are primarily non-ferrous at this point, fall to the lower surface of drum 63, gradually gravitating to the lower end of and falling to the pick-up end of conveyor 61. Conveyor 61 carries the collected non-ferrous metals up out of the water over the side wall 69 and deposits them on the pick-up end of conveyor 62 which, in turn, carries them to a collection container positioned below its discharge end. A minimal degree of manual sorting of materials may be appropriate as they move slowly along conveyors 56 and 62.

A complete and effective metal reclaiming system is thus provided in accordance with the stated objects of the invention. Although but a single embodiment of the invention is illustrated and described, it will be apparent to those skilled in the art that various changes and modifications may be made therein without departing from the spirit of the invention or from the scope of the appended claims.

What is claimed is:

1. A reclaiming system for recycling scrap material comprising in combination:

a hopper for receiving shredded material, a first conveyor means for moving said material out of said hopper onto a second conveyor means, said second conveyor means comprising a pair of conveyors positioned in a vertical array one above the other and means for shaking said first conveyor, one of said conveyors having perforations of a given size for dropping smaller first portion of said material therethrough onto the other of said conveyors for discharging into an intake hopper, said one of said conveyors depositing a second portion of said material into an air processing tower, means for generating air turbulence in said air processing tower for separating the heavier portions of said second portion of said material from the lighter portions, said tower discharging said lighter portions into a circulator and said heavier portions onto a third conveyor means, said circulator spiraling said lighter portions and through centrifugal action separating a substantially cleaned air stream for discharge into the atmosphere and discharging said lighter portions, a magnetic means mounted at the discharge end of said third conveyor means for attracting magnetically ferrous material moving along said third conveyor means at the discharge end thereof and holding said ferrous material on said third conveyor means to discharge it at a point beyond said discharge end thereof, the non-magnetic materials moving along said third conveyor means being discharged on to a shaker conveyor, said shaker conveyor being perforated to discharge through its perforations small particles of metal of said non-magnetic materials of a given size and discharging the remainder into a rotating drum, said rotating drum being angularly positioned for receiving said remainder, said drum receiving a given charge of turbulent water which discharges all material received less dense than metal through its elevated end for discharge onto a fourth conveyor means, all heavier pieces of said material received by said drum gravitating to its lower end of discharge onto a fifth conveyor means.

2. The reclaiming system set forth in claim 1 in further combination with:

a sump for collecting water discharge by said drum, and a water recirculating means for directing water from said sump to said drum.

3. The reclaiming system set forth in claim 1 wherein:

said magnetic means comprises a roller over which said third conveyor means moves.

4. The reclaiming system set forth in claim 1 wherein:

said drum comprises a nozzle for directing a high velocity stream of water onto the contents of said drum.

* * * * *